US007210195B2

(12) United States Patent
Howie et al.

(10) Patent No.: US 7,210,195 B2
(45) Date of Patent: May 1, 2007

(54) INTEGRATED SPIDER SEPARATOR

(75) Inventors: Mark Howie, Cadillac, MI (US); Eric Lee Gustafason, Cadillac, MI (US)

(73) Assignee: Rexair, Inc., Troy, MI (US)

( * ) Notice: Subject to any disclaimer, the term of this patent is extended or adjusted under 35 U.S.C. 154(b) by 561 days.

(21) Appl. No.: 10/460,100

(22) Filed: Jun. 12, 2003

(65) Prior Publication Data

US 2004/0068826 A1 Apr. 15, 2004

Related U.S. Application Data

(60) Provisional application No. 60/418,062, filed on Oct. 11, 2002.

(51) Int. Cl.
*B01D 47/00* (2006.01)
*A47L 9/18* (2006.01)

(52) U.S. Cl. ..... 15/353; 15/327.6; 55/DIG. 3; 96/333; 96/337

(58) Field of Classification Search ..... 15/327.6, 15/353; 55/406, DIG. 3; 95/270, 218; 96/333, 96/337, 339
See application file for complete search history.

(56) References Cited

U.S. PATENT DOCUMENTS 4,693,734 A * 9/1987 Erickson, Jr. ..... 55/472
5,090,974 A 2/1992 Kasper et al. ..... 55/95
5,096,475 A * 3/1992 Kasper et al. ..... 15/353
5,902,386 A 5/1999 Gustafson et al. ..... 96/333
6,090,174 A 7/2000 Douma et al. ..... 55/337
6,196,962 B1 3/2001 Purvey et al. ..... 494/49
6,391,101 B2 5/2002 Gustafson et al. ..... 96/333
6,551,230 B2 4/2003 Herman et al. ..... 494/75
6,553,614 B1 * 4/2003 Leon ..... 15/353
2004/0020004 A1 * 2/2004 Pogacar et al. ..... 15/353

FOREIGN PATENT DOCUMENTS

WO WO 02069778 9/2002

* cited by examiner

*Primary Examiner*—Theresa T. Snider
(74) *Attorney, Agent, or Firm*—Radner, Fishman & Grauer, PLLC

(57) ABSTRACT

A vacuum cleaner assembly comprising a body, a motor disposed within the body and having an output shaft for rotating about axis, a fan coupled to the output shaft for generating a vacuum airflow through an air intake port in the body, and a separator coupled to the output shaft. The separator includes a cup shaped body and a flange extending radially from the open top to an outer periphery. The separator includes a spider, integrated therewithin, having a hub portion surrounding the shaft, and a plurality of helical blades integral with and extending radially from the hub portion to the vanes and integral with the wall. The separator is one piece molded component that may provide for better turbulence characteristics during suction of the air, increase the centrifugal forces to separate the dust and debris from the air flow.

33 Claims, 5 Drawing Sheets

FIG - 4
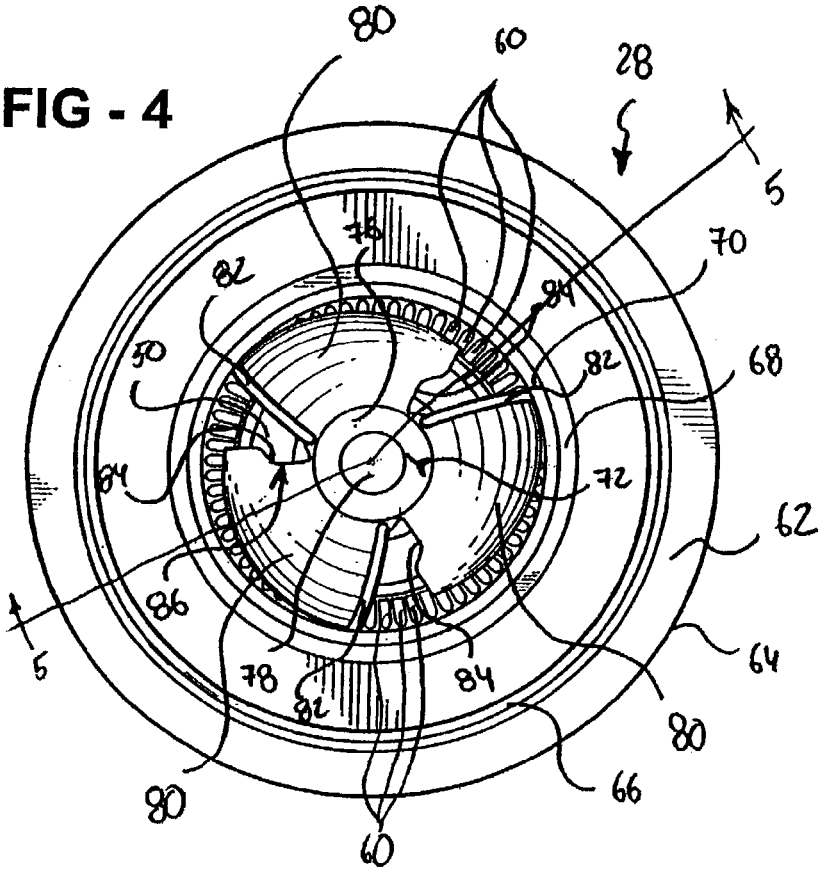
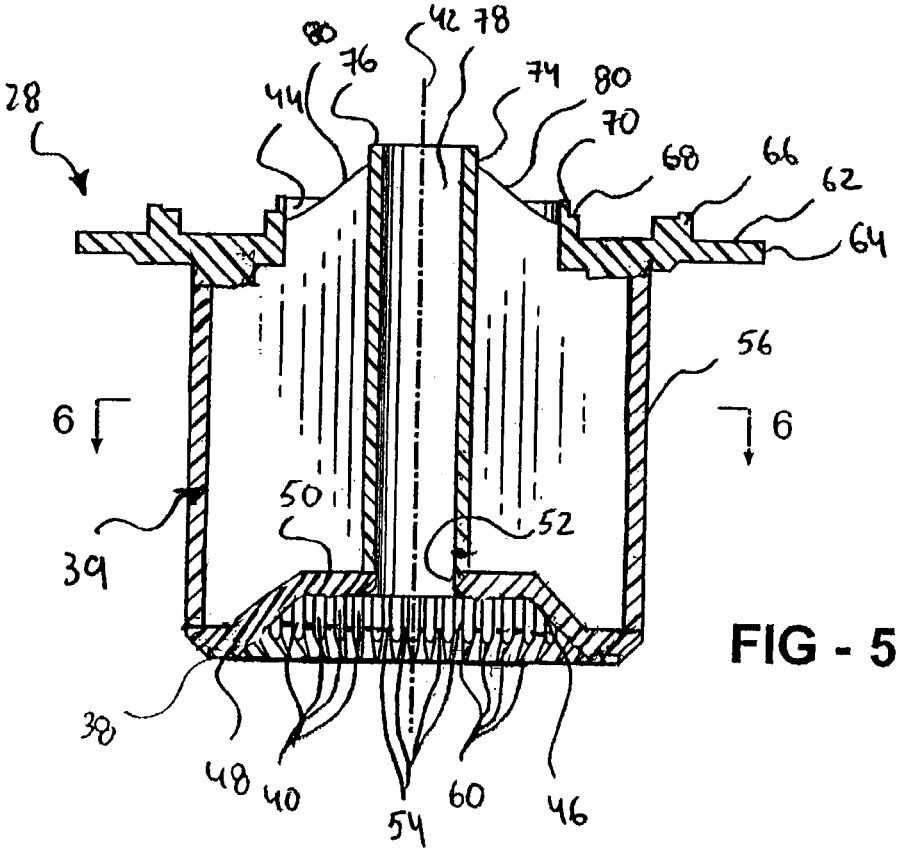
FIG - 5

FIG - 6
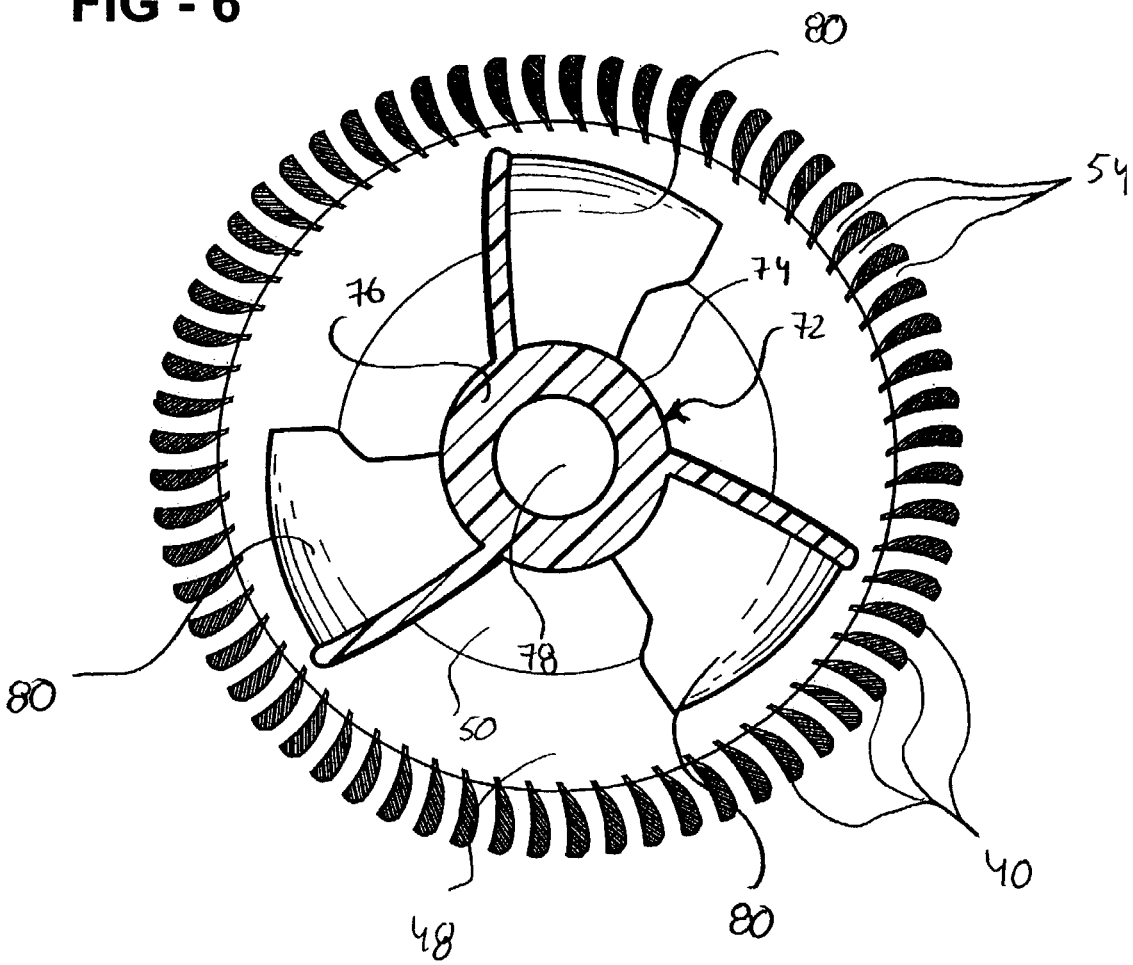
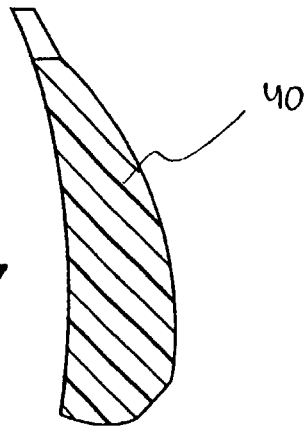
FIG - 7

INTEGRATED SPIDER SEPARATOR

This application claims priority to a provisional patent application having a Ser. No. of 60/418,062 filed on Oct. 11, 2002.

FIELD OF THE INVENTION

This invention relates to a vacuum cleaner of the type for household use, and more particularly to a separator with a spider coupled to an output shaft for generating centrifugal force within the separator and to prevent liquid from entering into an area between the spider and a blower housing.

BACKGROUND OF THE INVENTION

Vacuum cleaners of various designs are used in residential and commercial applications for cleaning. These vacuum cleaners create a suction airflow that picks up dirt and dust particulates from a surface to be cleaned. The vacuum cleaner separates these particulates from an ingested air for later disposal.

One type of vacuum cleaner design is a canister style vacuum cleaner with a water bath. Water bath vacuum cleaners typically include a main housing with a removably attached water bath pan. The ingested particulates are directed into a water bath that absorbs most of the particulates. The particulates are directed through an inlet in the main housing of the vacuum cleaner to an intake opening in the water bath pan.

The water bath vacuum cleaners typically include a separator assembly that is used to further separate the particulates from the ingested air that escapes entrapment within the water bath. Additionally, the separator can separate the particulates that are entrained within water droplets that are ingested into the separator. The separator provides additional filtration by centrifugation. To prevent the liquid particulates from entering the area between the separator and the output shaft of the motor disposed within the housing of the vacuum cleaner, the separator includes a spider. During vacuum cleaning process, the spider rotates with the separator and generates a counter airflow that helps to prevent the water droplets and the dust and dirt particulates from penetrating through the separator and entering inside the motor.

Numerous designs of a separator having a spider member, incorporated therewithin, are presently known in the art and shown, for example, in the U.S. Pat. No. 5,090,974 to Kasper et al. and U.S. Pat. No. 5,902,386 to Gustafson et al. featuring the spider removably attached to a housing of a separator. While prior art patents, cited above, disclose different designs of the separator including the spider incorporated therewithin, these prior art designs do not disclose a spider that may reduce a part count. The prior art separators do not provide for improved balancing during rotation of the separator, and do not provide an effective seal to prevent the liquid particulates from entering the area between the spider and the blower housing of the vacuum cleaner.

BRIEF SUMMARY OF INVENTION

The present invention is aimed at one or more of the problems identified above. In one aspect of the present invention, a vacuum cleaner assembly comprises a body, a motor disposed within the body and having an output shaft for rotating about an axis, a fan coupled to the output shaft for generating a vacuum airflow through an air intake port in the body, and a separator coupled to the output shaft for separating dust and dirt particulates. The separator includes a cup shaped body having a bottom and a plurality of vanes extending upwardly from the bottom about the bottom axis to an open top. The separator comprises a flange extending radially from the open top to an outer periphery and a wall integral with and extending from the flange above the open top. The invention includes a spider defined by a hub portion surrounding the shaft and extending upwardly from the bottom to an upper end disposed above the wall.

In another aspect of the present invention an integrated spider separator for use in a vacuum cleaner assembly that has a body, a motor disposed within the body having an output shaft for rotating about an axis, a fan coupled to the output shaft for generating a vacuum airflow through an air intake port in the housing comprises a separator that includes a body having a bottom surrounded by a wall to expose an open top and coupled to the output shaft for separating dust and dirt particles. The separator includes a flange integral with the open top of the body of the separator and extending radially from the open top to an outer periphery and a spider integral with the flange and extending upwardly from the bottom to the open top.

BRIEF DESCRIPTION OF THE DRAWINGS

Other advantages of the present invention will be readily appreciated as the same becomes better understood by reference to the following detailed description when considered in connection with the accompanying drawings wherein:

FIG. 4 is an overhead view of the integrated separator of FIG. 2 showing the blades and the beveled edges of the vanes;

FIG. 5 is a cross section along lines 5—5 of FIG. 4;

FIG. 6 is a cross-section along lines 6—6 of FIG. 3;

FIG. 7, is an enlarged cross-section of a single vane from FIG. 6; and

DETAILED DESCRIPTION OF THE INVENTION

Figure 1:
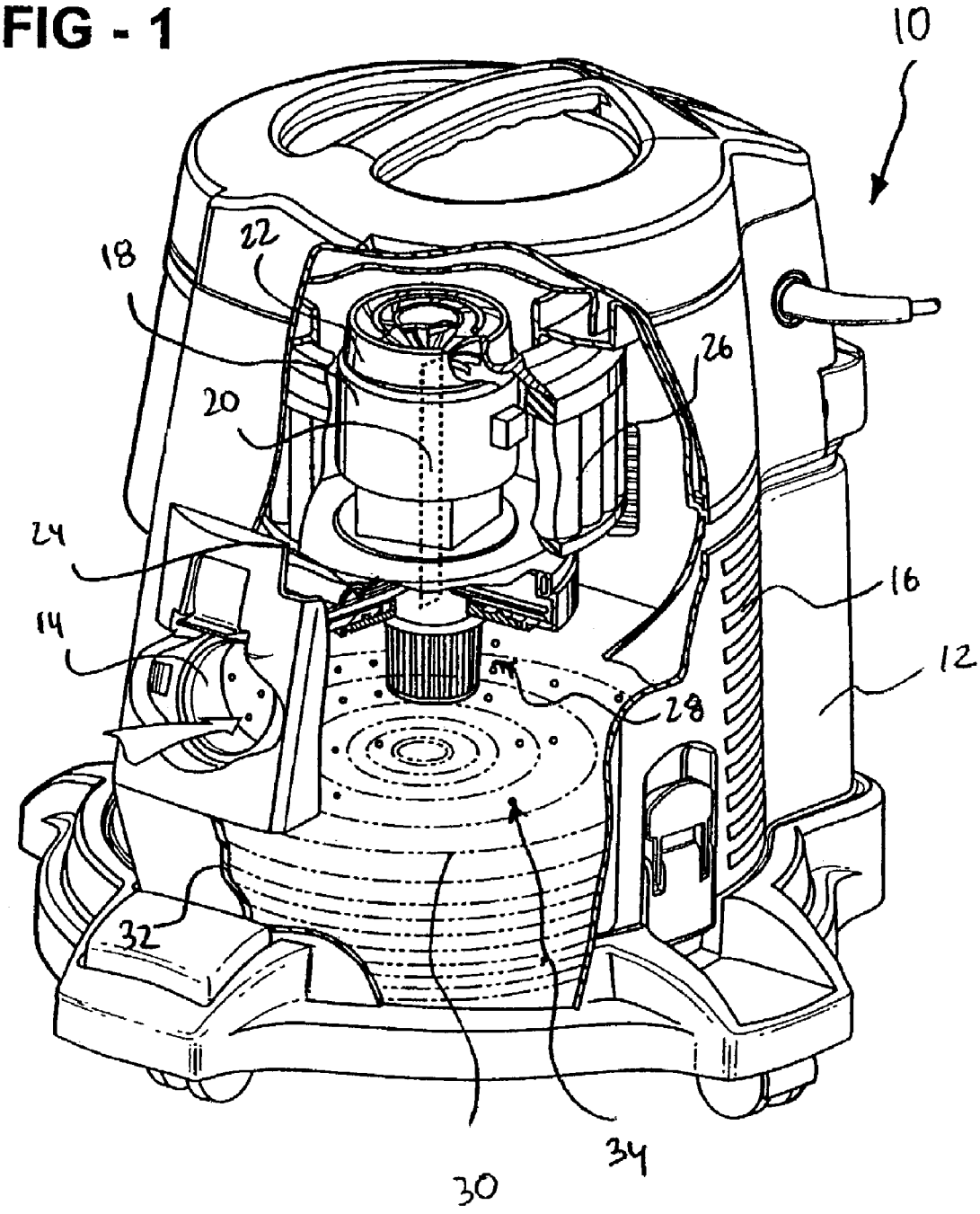
FIG. 1 is a perspective view of the vacuum cleaner assembly, partially broken away and in cross section.

Referring to the Figures, wherein like numerals indicate like or corresponding parts throughout the several views a vacuum cleaner assembly is generally shown at 10. The vacuum cleaner assembly 10 comprises a body 12 having an intake port 14 and an outlet 16. A motor 18 is disposed within the body 12 between the intake port 14 and the outlet 16 wherein the motor 18 includes an output shaft 20 for rotating about an axis. The assembly 10 includes a cooling fan 22, mounted within the body 12 above the motor 18 and coupled to the output shaft 20 for generating a vacuum airflow through the intake port 14 in the body 12 and to circulate cooling air around the motor 18. The assembly comprises a cooling air filter 26 surrounding the motor 18 wherein the cooling air filter 26 directs the cooling air around the motor 18 and filters the cooling air prior to being exhausted. The assembly 10 includes a blower 24 that is mounted within the body 12 below the motor 18. The blower 24 provides for drawing air into the intake port 14 and exhausting air outwardly through the outlet 16.

The assembly 10 includes a separator, generally shown at 28, coupled to the output shaft 20 to separate dust and dirt particulates. The separator 28 is mounted below the blower 24 and is designed to circulate the air and a water bath 30 within a water bath pan 32. A combination of the water bath pan 32 and the water bath 30 is used as a primary filter for filtering particulates, generally indicated at 34, from the air prior to exhausting the air outwardly through the outlet 16.

Figure 2:
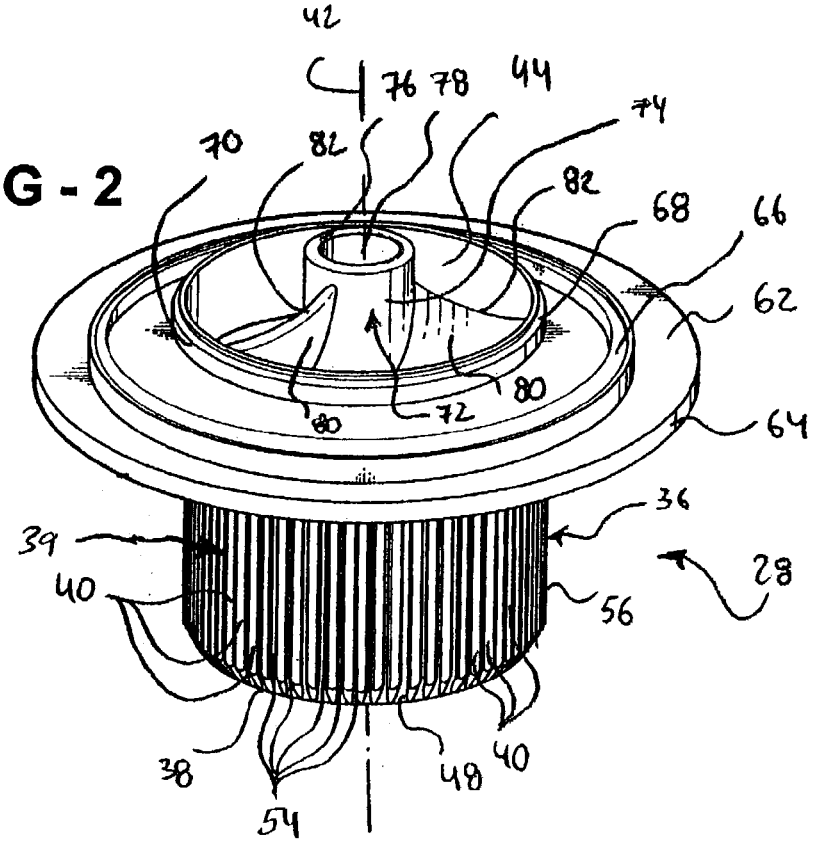
FIG. 2 is a perspective view of the integrated separator with spider.
Figure 3:
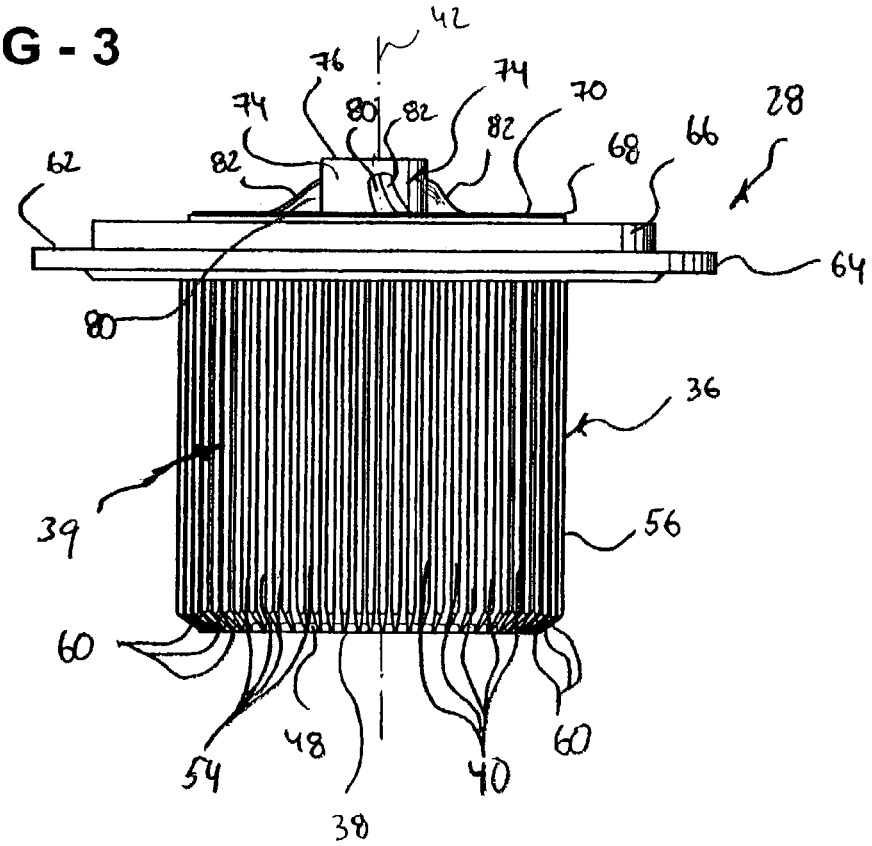
FIG. 3 is a side view of the separator of FIG. 2 showing the beveled bottom edge portions.

As shown in FIGS. 2 and 3, the separator 28 includes a cup shaped body, generally indicated at 36, having a bottom, generally indicated at 38, and a wall, generally indicated at 39, further defined by a plurality of vanes 40 extending upwardly from the bottom 38 about the bottom axis 42 to an open top 44. The vanes 40 comprise a curved flow surface for increased particulate separation and reductions in aerodynamic losses as the body 36 rotates about the axis 42. The vanes 40 extend longitudinally with respect to the body 36 and are generally tapered radially relative to the axis of rotation, i.e., like an air foil. The curved flow surface extends along the length of each of the vanes 40.

Referring to FIG. 5, the bottom 38 of the separator 28 comprises a truncated portion, generally indicated at 46, extending axially from a lower bottom 48 toward the open top 44 and then to an upper bottom 50. The upper bottom 50 defines an aperture 52 therein on the axis 42.

The longitudinally extending vanes 40 define a plurality of longitudinal gaps or openings 54, formed therebetween. The fluid and p articulates 34 are drawn into the exterior of the separator 28 via the gaps 54. As the particulates 34 are drawn in, separator body 28, which rotates at a high angular velocity, applies a centrifugal force to the particulates 34 and the air and water. The particulates 34 are forced outwardly against an outer surface 56 of the separator body 36 where they can be expelled back into the water bath 30 below. The cleaned air is then exhausted from the separator 28 and out through the outlet 16.

Referring back to FIGS. 2 through 5, the longitudinally extending vanes 40 include a beveled bottom edge portion 60 that extends outwardly beyond the bottom portion 38. This beveled bottom edge portion 60 significantly reduces foaming that occurs due to the addition of cleaning chemicals or fragrances to the water bath 30. The beveled bottom edge portions 60 on each of the vanes 40 reduces a propeller or churning effect created by rotation of the separator 28 and thus reduces foaming. Preferably, the separator 28 is formed from a rigid material such as glass filled polystyrene material, and the like, and is injection molded.

The separator 28 includes a flange 62 extending radially from the open top 44 to an outer periphery 64 and an annular ridge 66 integral with and extending axially from the flange 62 between the periphery 64 and the open top 44. The separator 28 includes a flange wall 70 integral with and extending from the flange 62 above the open top 44. The wall 70 further comprises an annular lip 68 integral with and disposed on the flange wall 70.

Figure 8:
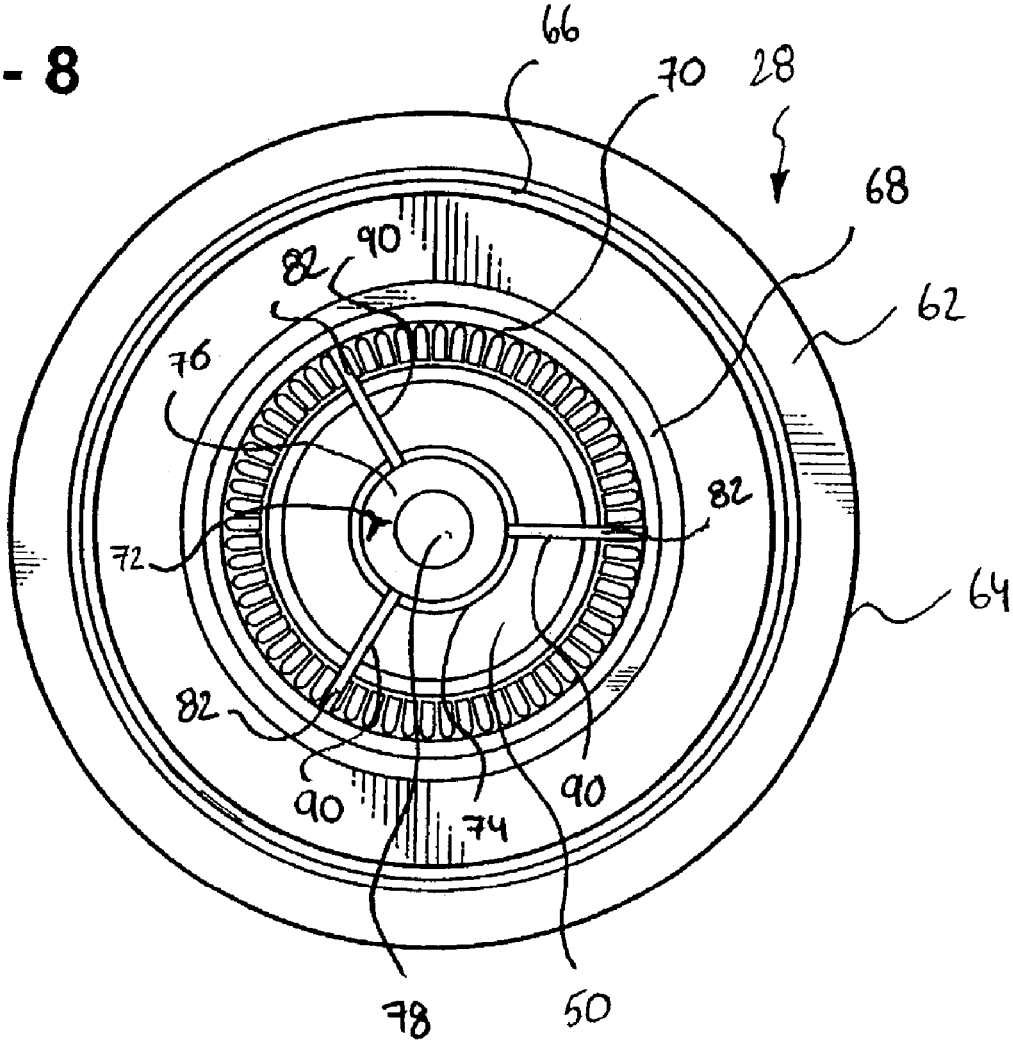
FIG. 8 is an overhead view of an alternative embodiment of the integrated separator of FIG. 2 showing the blades and the beveled edges of the vanes.

As shown in FIGS. 2 through 5, the separator 28 comprises a spider, generally indicated at 72, being integral with the flange 62. The spider 72 includes a hub portion 74 surrounding the shaft 20 and extending upwardly from the upper bottom 50 to an upper end 76 disposed above the flange wall 70. The hub portion 74 has a bore 78 aligned with the aperture 52 wherein the bore 78 is designed to receive a bolt (not shown) when the separator 28 is coupled with the output shaft 20. The spider 72 includes a plurality of blades 80 integral with and extending radially and outwardly from the hub portion 74 in a helical configuration to the vanes 40 and integral with the wall 70. As best shown in FIG. 4, each blade 80 comprises a top 82 and a bottom 84 ends wherein each bottom end 84 of the blade 80 defines a groove, generally indicated at 86, to engage the truncated portion 46 defined by the upper 50 and lower 48 bottoms. Although the illustrated embodiment shows the blades 80 integral with and extending radially and outwardly from the hub portion 74 in a helical configuration to the vanes 40, other blade designs may be used. For example, in one alternative embodiment, shown in FIG. 8, blades 90 are straight and extend diagonally from the hub portion 74 of the spider 72.

The spider 72 rotates with the separator 28 and generates a counter airflow that helps to prevent the water droplets (not shown) and the dirt and dust particulates 30 from penetrating through the separator 28 and entering inside the motor 18. In addition, the spider 72 provides a seal that prevents dirt-entrained liquid from entering between the spider 72 and the blower 24. Preferably, the spider 72, the flange 62, and the wall 70 are integrally formed from a rigid material such as glass filled polystyrene material, and the like, and are injection molded.

The invention has been described in an illustrative manner, and it is to be understood that the terminology, which has been used, is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A vacuum cleaner assembly comprising:

a body;

a motor disposed within said body and having an output shaft for rotating about an axis;

a fan coupled to said output shaft for generating a vacuum airflow through an air intake port in said body;

a cooling air filter surrounding said motor wherein said cooling air filter directs the cooling air around said motor and filters the cooling air prior to being exhausted;

a blower mounted within said body below said motor providing for drawing air into said intake port and exhausting air outwardly through an outlet;

a separator coupled to said output shaft for separating dust and dirt particulates and including a cup shaped body having a bottom and a plurality of vanes extending upwardly from said bottom about said bottom axis to an open top;

said bottom having a truncated portion extending axially from a lower bottom toward said open end to an upper bottom;

said upper bottom having an aperture therein on said axis;

a flange extending radially from said open top to an outer periphery;

an annular ridge integral with and extending axially from said flange between said periphery and said open top;

a wall integral with and extending from said flange above said open top;

an annular lip integral with and disposed on said wall;

a hub portion surrounding said shaft and extending upwardly from said upper bottom to an upper end disposed above said wall and having a bore aligned with said aperture;

a plurality of blades integral with and extending radially and outwardly in a helical configuration from said hub portion to said vanes and integral with said wall, said blades engaging said truncated portion and said upper and lower bottoms; and said helical blade including top and bottom ends wherein each bottom end of said blade defining a groove to engage said truncated portion.

2. A vacuum cleaner assembly comprising:

a body;

a motor disposed within said body and having an output shaft for rotating about an axis;

a fan coupled to said output shaft for generating a vacuum airflow though an air intake port in body;

a separator having a body including a bottom surrounded by a wall to expose an open top and coupled to said output shaft for separating dust and dirt particles, said bottom further defined by lower and upper bottoms and a truncated portion extending axially from said lower bottom toward said open top to said upper bottom;

a flange integral with said open top of said separator body and extending radially from said open top to an outer periphery; and a spider integral with said flange and extending upwardly from said bottom to said open top, said spider including a hub portion having a bore and a plurality of blades extending radially and outwardly from said hub portion, said plurality of blades engaging a said truncated portion and said upper and lower bottoms of said separator body, each blade including top and bottom ends wherein each bottom end of said blade defines a groove to engage said truncated portion.

3. A vacuum cleaner assembly comprising:

a body;

a motor disposed within said body and having an output shaft for rotating about an axis;

a fan coupled to said output shaft for generating a vacuum airflow through an air intake port in said body;

a separator having a body including a bottom surrounded by a wall to expose an open top and coupled to said output shaft for separating dust and dirt particles;

a flange integral with said open top of said separator body and extending radially from said open top to an outer periphery;

a wall integral with and extending from said flange above said open top; and a spider integral with said flange and extending upwardly from said bottom to said open top.

4. The assembly as set forth in claim 3 wherein said spider includes a hub portion having a bore and a plurality of blades integral with and extending radially and outwardly from said hub portion.

5. The assembly as set forth in claim 4 wherein each blade is straight and extends diagonally from said hub portion of said spider.

6. The assembly as set forth in claim 4, wherein the blades extend outwardly from said hub portion in a helical configuration.

7. The assembly as set forth in claim 3 wherein said body of said separator is cup shaped.

8. The assembly as set forth in claim 3 wherein said wall of said separator is further defined by a plurality of vanes extending upwardly from said bottom about said axis to said open top.

9. The assembly as set forth in claim 8 including a plurality of longitudinal gaps defined between said vanes.

10. The assembly as set forth in claim 3 wherein said bottom is further defined by lower and upper bottoms and a truncated portion extending axially from said lower bottom toward said open top to said upper bottom.

11. The assembly as set forth in claim 10 wherein said upper bottom has an aperture therein on said axis.

12. The assembly as set forth in claim 11 wherein said spider has a hub portion having a bore, wherein said bore of said hub portion is aligned with said aperture.

13. The assembly as set forth in claim 3 including an annular ridge integral with and extending axially from said flange between said periphery and said open top.

14. The assembly as set forth in claim 3 including an annular lip integral with and disposed on said wall.

15. The assembly as set forth in claim 3 wherein said spider, said flange, and said wall are integrally formed from a rigid material.

16. The assembly as set forth in claim 15 wherein said rigid material is a glass filled polystyrene.

17. The assembly as set forth in claim 15 wherein said spider, said flange, and said wall are injection molded.

18. An integrated spider separator for use in a vacuum cleaner assembly having a body, a motor disposed within said body and having an output shaft for rotating about an axis, a fan coupled to said output shaft for generating a vacuum airflow through an air intake port in said body comprising:

a separator having a body including a bottom surrounded by a wall to expose an open top and coupled to said output shaft for separating dust and dirt particles, said bottom further defined by lower and upper bottoms and a truncated portion extending axially from said lower bottom toward said open top to said upper bottom;

a flange integral with said open top of said separator body and extending radially from said open top to an outer periphery; and a spider integral with said flange and extending upwardly from said bottom to said open top, said spider including a hub portion having a bore and a plurality of blades extending radially and outwardly from said hub portion, said plurality of blades engaging said truncated portion and said upper and lower bottoms of said body, each blade including top and bottom ends wherein each bottom end of said blade defines a groove to engage said truncated portion.

19. An integrated spider separator for use in a vacuum cleaner assembly having a body, a motor disposed within said body and having an output shaft for rotating about an axis, a fan coupled to said output shaft for generating a vacuum airflow through an air intake port in said body comprising:

a separator having a body including a bottom surrounded by a wall to expose an open top and coupled to said output shaft for separating dust and dirt particles;

a flange integral with said open top of said separator body and extending radially from said open top to an outer periphery;

a wall integral with and extending from said flange above said open top; and a spider integral with said flange and extending upwardly from said bottom to said open top.

20. The integrated spider separator as set forth in claim 19 wherein said spider includes a hub portion having a bore and a plurality of blades integral with and extending radially and outwardly from said hub portion.

21. The integrated spider separator as set forth in claim 20 wherein each blade is straight and extends diagonally from said hub portion of said spider.

22. The integrated spider separator as set forth in claim 20 wherein the blades extend outwardly from said hub portion in a helical configuration.

23. The integrated spider separator as set forth in claim 19 wherein said body of said separator is cup shaped.

24. The integrated spider separator as set forth in claim 19 wherein said wall of said separator is further defined by a plurality of vanes extending upwardly from said bottom about said axis to said open top.

25. The integrated spider separator as set forth in claim 24 including a plurality of longitudinal gaps defined between said vanes.

26. The integrated spider separator as set forth in claim 19 wherein said bottom is further defined by lower and upper bottoms and a truncated portion extending axially from said lower bottom toward said open top to said upper bottom.

27. The integrated spider separator as set forth in claim 26 wherein said upper bottom has an aperture therein on said axis.

28. The integrated spider separator as set forth in claim 27 wherein said spider includes a hub portion having a bore, wherein said bore of said hub portion is aligned with said aperture.

29. The integrated spider separator as set forth in claim 19 including an annular ridge integral with and extending axially from said flange between said periphery and said open top.

30. The integrated spider separator as set forth in claim 19 including an annular lip integral with and disposed on said wall.

31. The integrated spider separator as set forth in claim 19 wherein said spider, said flange, and said wall are integrally formed from a rigid material.

32. The integrated spider separator as set forth in claim 31 wherein said rigid material is a glass filled polystyrene.

33. The integrated spider separator as set forth in claim 31 wherein said spider, said flange, and said wall are injection molded.

* * * * *